US010428537B2

(12) United States Patent
Hayman

(10) Patent No.: US 10,428,537 B2
(45) **Date of Patent: *Oct. 1, 2019**

(54) MODULAR SCAFFOLDING HORIZONTAL END CONNECTOR

(71) Applicant: Excel Modular Scaffold and Leasing Corporation, Walker, LA (US)

(72) Inventor: Yates W. Hayman, Walker, LA (US)

(73) Assignee: Excel Modular Scaffold and Leasing Corporation, Walker, LA (US)

( * ) Notice: Subject to any disclaimer, the term of this patent is extended or adjusted under 35 U.S.C. 154(b) by 571 days.

This patent is subject to a terminal disclaimer.

(21) Appl. No.: 15/148,667

(22) Filed: May 6, 2016

(65) Prior Publication Data

US 2016/0251864 A1 Sep. 1, 2016

Related U.S. Application Data

(63) Continuation of application No. 14/549,855, filed on Nov. 21, 2014, now Pat. No. 9,347,230, which is a continuation of application No. 13/527,730, filed on Jun. 20, 2012, now Pat. No. 8,905,292, which is a continuation-in-part of application No. 12/489,166, filed on Jun. 22, 2009, now Pat. No. 8,206,052.

(51) Int. Cl.

| | |
|---|---|
| ***E04G 7/22*** | (2006.01) |
| ***E04G 7/34*** | (2006.01) |
| ***E04G 7/02*** | (2006.01) |
| ***E04G 7/30*** | (2006.01) |
| ***E04G 1/15*** | (2006.01) |
| ***E04G 5/06*** | (2006.01) |
| ***E04G 7/06*** | (2006.01) |

(52) U.S. Cl.

CPC ..... *E04G 7/02* (2013.01); *E04G 1/152* (2013.01); *E04G 5/061* (2013.01); *E04G 7/06* (2013.01); *E04G 7/22* (2013.01); *E04G 7/307* (2013.01); *E04G 7/34* (2013.01)

(58) Field of Classification Search

CPC .... E04G 7/02; E04G 7/06; E04G 7/22; E04G 7/30; E04G 7/34

See application file for complete search history.

(56) References Cited

U.S. PATENT DOCUMENTS

| | | | |
|---|---|---|---|
| 4,300,657 | A | 11/1981 | Thompson |
| 4,445,307 | A | 5/1984 | Puccinelli et al. |
| 4,577,367 | A | 3/1986 | Durand |
| 4,603,756 | A | 8/1986 | Layher |
| 5,028,164 | A | 7/1991 | Williams |
| 5,078,532 | A | 1/1992 | Williams |
| 5,217,314 | A | 6/1993 | Perruelle |
| 5,713,687 | A | 2/1998 | Schworer |
| 6,375,405 | B1 | 4/2002 | Kallevig |
| 7,017,710 | B2 | 3/2006 | Booysen et al. |

(Continued)

FOREIGN PATENT DOCUMENTS

JP 06288082 A 10/1994

*Primary Examiner* — Michael P Ferguson
(74) *Attorney, Agent, or Firm* — Jones Walker LLP

(57) ABSTRACT

An end connector for a horizontal scaffold member includes two sidewalls that are substantially parallel joined to a pipe. Each side wall has two spaced apart engagement section. The sidewalls extend into the interior of the pipe and remain substantially parallel in the interior of the pipe. A movable latch is positioned between the two sidewalls.

18 Claims, 16 Drawing Sheets

(56) References Cited

U.S. PATENT DOCUMENTS

| | | | | |
|---|---|---|---|---|
| 7,048,093 | B2 | 5/2006 | Wallther | |
| 7,971,686 | B1 | 7/2011 | Hayman | |
| 8,206,052 | B1 | 6/2012 | Hayman | |
| 9,347,230 | B1 * | 5/2016 | Hayman | E04G 7/02 |
| 2007/0068733 | A1 | 3/2007 | Schlecht | |
| 2009/0052980 | A1 | 2/2009 | Williams | |
| 2011/0297483 | A1 | 12/2011 | Breithaupt, Jr. | |
| 2012/0181111 | A1 | 7/2012 | Brinkmann | |
| 2012/0186910 | A1 | 7/2012 | Thacker et al. | |
| 2012/0219354 | A1 | 8/2012 | Bauer et al. | |
| 2013/0177346 | A1 | 7/2013 | Brinkmann | |

* cited by examiner

MODULAR SCAFFOLDING HORIZONTAL END CONNECTOR

CROSS-REFERENCE TO RELATED APPLICATIONS

This application is a continuation of U.S. patent application Ser. No. 14/549,855, filed on Nov. 21, 2014, which is a continuation of U.S. patent application Ser. No. 13/527,730, filed on Jun. 20, 2012, which issued as U.S. Pat. No. 8,905,292 on Dec. 9, 2014, which is a continuation in part of U.S. patent application Ser. No. 12/489,166, filed on Jun. 22, 2009, which issued as U.S. Pat. No. 8,206,052 on Jun. 26, 2012, all of which are incorporated by reference herein in their entirety.

BACKGROUND OF THE INVENTION

The invention is in the field of scaffolding.

DESCRIPTION OF RELATED ART

Modular scaffolding is a scaffolding system having horizontal scaffold members and vertical scaffold members designed to be clipped or coupled together at a scaffold joint to create a scaffold structure. Once a scaffold structure is assembled, scaffold planks or boards are placed across horizontal scaffold members to create a scaffold deck or working surface. Scaffold planks are usually designed to couple to horizontal scaffold members—generally, the end of each plank has two hook sections, one at each side of the plank, sized to couple with the horizontal scaffold pipe.

A scaffold joint comprises a connector on the vertical scaffold member that is designed to couple or mate with a connector on a horizontal scaffold member, thereby joining together a horizontal and vertical scaffold member. One type of modular scaffold joint uses an end connector positioned on the end of a horizontal member, where the end connector has lip or hook sections. The lip sections are designed to engage or rest on cups or annuli rings positioned on a vertical scaffold member. One such joint is disclosed in U.S. Pat. No. 4,445,307, which discloses a connector positioned on a horizontal scaffold member, where the connector has two vertically spaced hook sections. These hook sections couple with two vertically spaced upstanding ring members located on the vertical scaffold member. To lock the joint in place, the connector includes a wedge that is driven (generally by a hammer) into position below the upper ring member, thereby wedging the ring against the end connector hood section, latching the horizontal member to the vertical member. As used herein, "latching" refers to the action of engaging a horizontal member to a vertical member, where the action of latching resists dislodgement of the horizontal member from the vertical member from an upwardly directed force.

A second type of latching connector is disclosed in U.S. Pat. Nos. 5,078,532 and 5,028,164, hereby incorporated by reference. These patents also show an end connector positioned on a horizontal scaffold member, where the connector has two vertically spaced hooked sections that couple with two vertically spaced upstanding ring members located on the vertical scaffold member. In this device, the latching of the ring members to the hooked sections is accomplished by a deploying a pivoting member or latch, positioned on the end connector, into position below the top ring member. The latch member has a distal end extending beyond the housing, shaped to allow for placement of the distal end beneath a cup or annular ring positioned on a vertical scaffold member. Hence, when latched, the cup or annular ring is trapped between the hook engagement sections of the connector housing and the distal end of the latch member. The latch pivots on a pivot pin, and can be spring loaded to bias the latch into a locking or actuated position.

The proximal end of the latch extends beyond the housing to create a handle, allowing an operator to grasp the handle to actuate or release the latch member. This action allows for hand actuation of the latch for engagement and disengagement, an improvement over the hammer driven wedge of the U.S. Pat. No. 4,445,307. The pivoting latch member allows for ease of assembly of a scaffold structure, and the assembled joint retains a degree of play, as this connector lacks the wedging action of the '307 patented device.

A third type of latching mechanism is disclosed in U.S. application Ser. No. 11/738,273, filed Apr. 20, 2007 (hereby incorporated by reference). This application teaches a horizontal scaffold member having an end connector with two hooks or engagement areas, each designed to couple with a ring or annulus located on a vertical member. The connector includes an upper and a lower latch, each the respective upper and lower coupled ring or cup members. The two latches are mechanically coupled allowing for single action operation to engage or disengage both latches simultaneously.

On each of these modular systems, the horizontal and vertical scaffold members are constructed of hollow steel pipe, preferably galvanized pipe. A commonly used pipe is 1¾ inch diameter steel pipe, having ⅛ inch wall thickness. The end connector is fixed to the end of the horizontal pipe scaffold member, usually by welding the connector to the outside of the pipe. Hence, the end of the horizontal scaffold member, at the connector joint, is thicker than the horizontal pipe member (by at least ¼ inch, if ⅛ inch steel is used to construct the connector) due to the presence of the end connector. This increase in thickness is problematic when attaching a scaffold deck.

Scaffold planks or boards are coupled across horizontal members to create a decking or working surface. Scaffold planks used in a modular system are generally a steel plate having two downward directed side channels that provide rigidity to the plank. See FIGS. 8A and 8B. Each end of the plank has a cutout or hook section 500 on each side channel, designed to engage a horizontal scaffold pipe member (e.g. a semicircular cutout to engage a round pipe member). For ease of manufacturing and assembly of a scaffold plank, the plank end side channel cutouts are usually separate metal pieces that are later welded or otherwise joined to the plank's side channels.

The existing scaffold end connector comprises a housing, where the latching, latch pivot pins, springs and spring pivot pins, etc. are generally maintained in the interior of the housing. The housing is manufactured from plate steel using a die to cut and shape the connector form, and several connectors will be cut at the same by the die. See FIG. 6, detailing the shape of the initial die housing layout. Initial action of the die operation cuts the two sides of an end connector housing 600 and 610, which are joined by rear sections 800A and 800B, and also punches holes in the housing sides to accommodate the latch and spring pivot pins. Adjoining end connectors are joined by metal fingers 750 that will be later removed and discarded. After the initial cut, the die operation will also initially shape each end connector into a desired form—the lateral tabs are bent at ninety degrees, the tops sides of the housing 700 will be shaped to resemble a portion of a cylindrical body (for engagement with the exterior of the horizontal pipe member), and the bottom of the two sides are also flared outwardly (to create a larger mouthed hook section for additional surface area support by a cup on a vertical scaffold member). See FIGS. 7A-7C. In the final die operation, the projecting fingers 750 are removed and the two sides of the housing 600, 610 are folded into an opposing relationship (e.g. the two sides are parallel), by folding or bending rear sections 800A and 800B into a "U" configuration (see FIG. 7A). The die operation may take several discrete steps (e.g. punch out general shape, form the cylindrical top ends, and bend the two sides into an opposing relationship).

After the die operation, two formed end connectors are placed in a jig, a horizontal pipe positioned between the two connectors, and a reinforcing brace positioned on each end connector. The assembled horizontal scaffold member is then welded to form a unitary horizontal scaffold member—the bent lateral tabs on each end connector are welded to the opposing housing side (fixedly joining the two sides of the housing together), the horizontal pipe is welded to the cylindrical sections 700 of the connector sides, and the brace is welded to the end connector and the pipe. Given the construction of the joint, welds are required on the front and rear face of the end connector (to join the lateral tabs), and the top and bottom of the pipe (to join the connector to the pipe), as well as two welds required for the brace. The finished welded end connector has an internal space between the two sides of the housing to accommodate placement of the chosen latch device. The springs, pivot pins and latch members are next installed in the end connector interior to create a finished horizontal scaffold member.

The current end connector design is opened on the top of the connector (see FIG. 7A), thereby exposing the pivot pins and latch members to possible damage from debris falling into the open top (such as mortar, screws, etc.) Also, the end connector is formed by bending and stretching portions of the punched connector form—e.g., the two sides of the connector are formed from a single piece of metal and bent into an opposing relationships, while the top of the connector is physically stretched and deformed to form the cylindrical top portions 700. This bending and deformation can cause misalignment of the two opposing sides, creating a twisted end connector with pivot pin holes that do not align properly and with top and bottom hook sections that may be misaligned for proper engagement with the vertical scaffold member. The inventors have found that about 10% of end connectors have twisted sides or other alignment issues that either make the end connector unusable, or requires hand correction, a time consuming operation. A twisted end connector may create safety issues, and such may not be apparent until after the horizontal scaffold member joint is completed and it is discovered that the twisted horizontal scaffold member will not properly engage the cups on vertical scaffold members on one or both ends of the horizontal scaffold member.

Finally, the end connector adjacent to the horizontal pipe 200 is wider than the horizontal pipe (See FIG. 7B). Consequently, scaffold boards cannot be place over the end connector joint, as the hook sections of the scaffold boards 500 are sized for the pipe 200, not the wider joint of top section 700 to pipe 200. Hence, a gap of about three inches is created in the working surface near a vertical scaffold member—that is, the edge of the working surface stops about three inches from a vertical "wall" of a scaffold structure (see FIG. 7B). A new housing is needed that avoids these problems.

Finally, the present hand actuated latching mechanisms, either the single latch or double latch mechanisms, do not provide a secure positive lock. That is, while these latches resist dislodgment by an upward force, a sufficient twisting force may still dislodge a horizontal member from a vertical member. A positive locking latch is also needed.

BRIEF SUMMARY OF THE INVENTION

The invention is an end connector for a horizontal scaffold member where the top of the end connector is inserted into the interior of a scaffold pipe. The invention includes a locking latch that includes a rotating latch member and a rotating lock that interfere when the latch is locked.

DETAILED DESCRIPTION OF THE INVENTION

End Connector Housing

Figure 1:
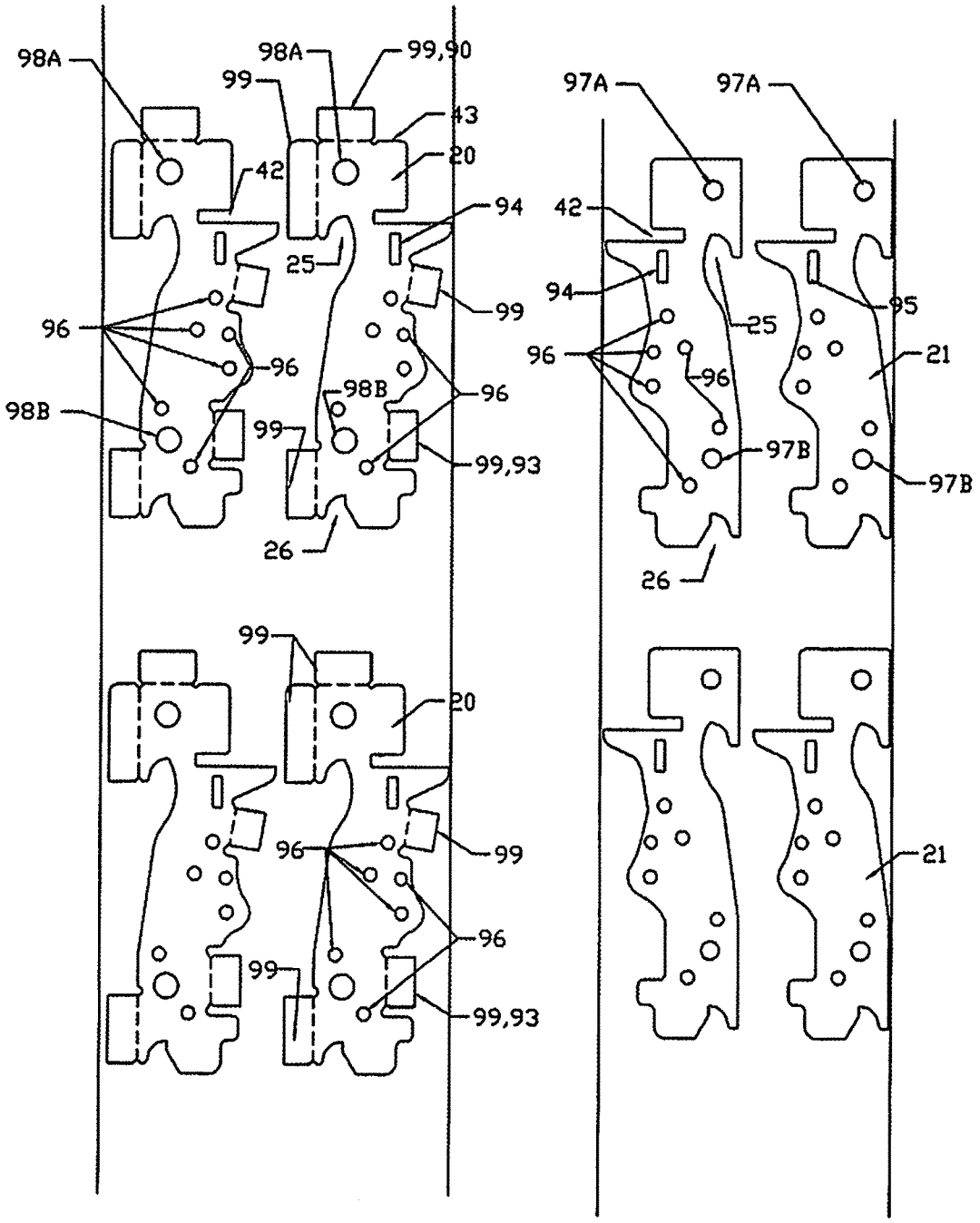
FIG. 1 depicts plate steel with the two sides of one embodiment of the housing outlined on the steel, to be cut by a die operation.
Figure 2:
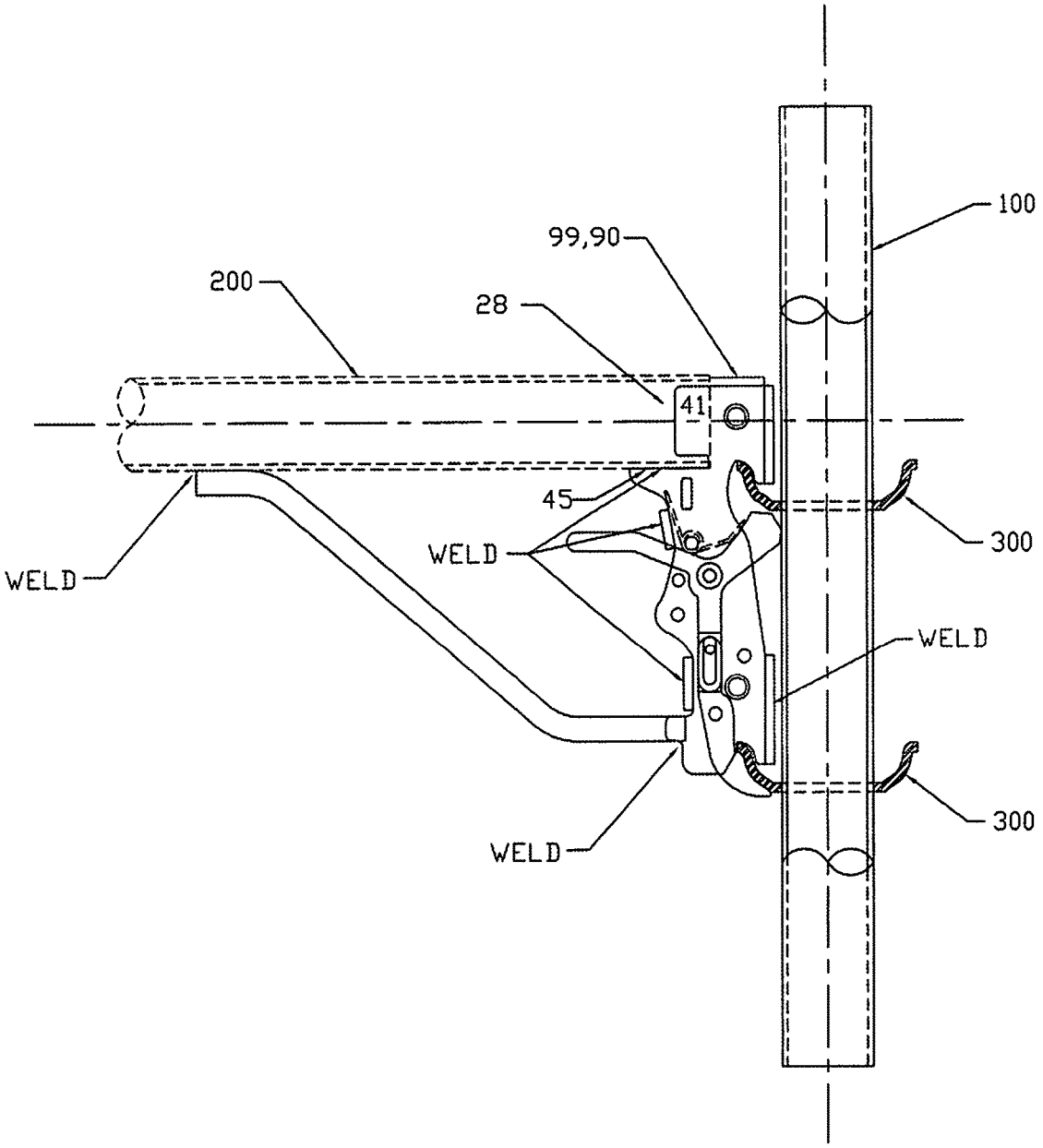
FIG. 2 is a cross section through one embodiment of a connector housing installed in a scaffold joint, where a dual latch member is deployed within the connector housing.
Figure 11:
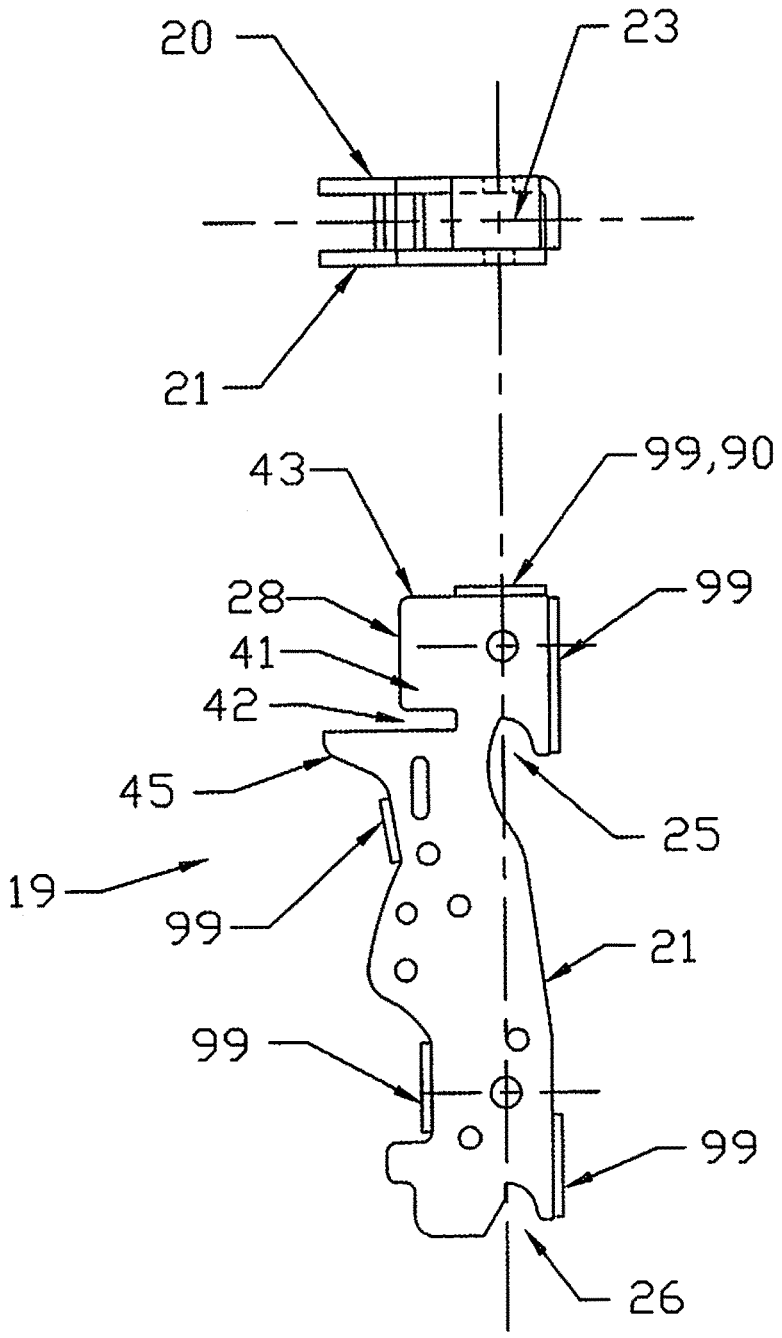
FIG. 11 is a side view of the horizontal connector formed by the cutouts of FIG. 1.
Figure 12A:
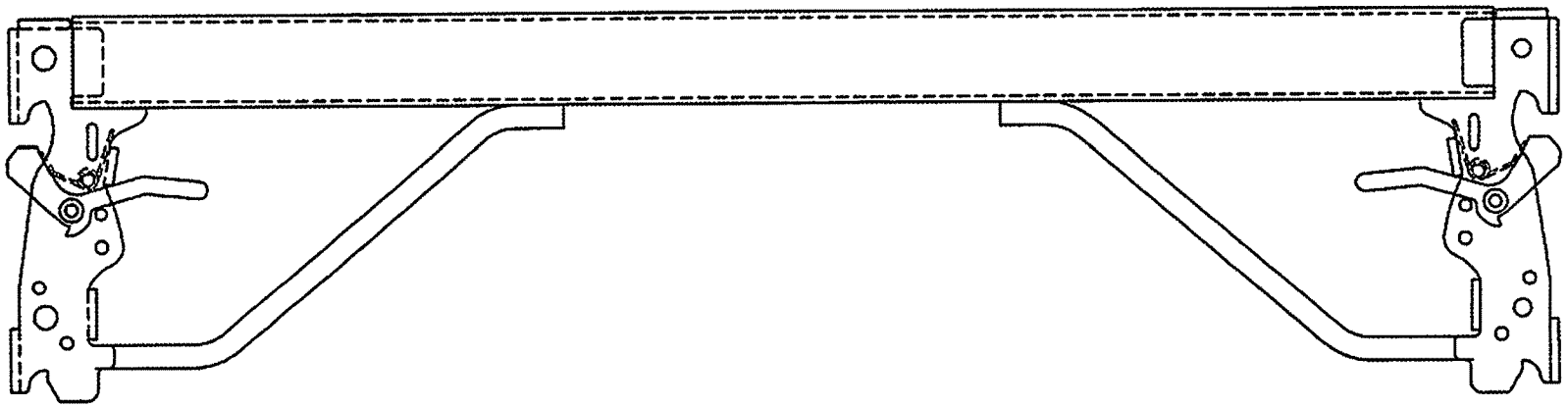
FIGS. 12A-D are cross sections through horizontal scaffold members showing different latching configurations.
Figure 12B:
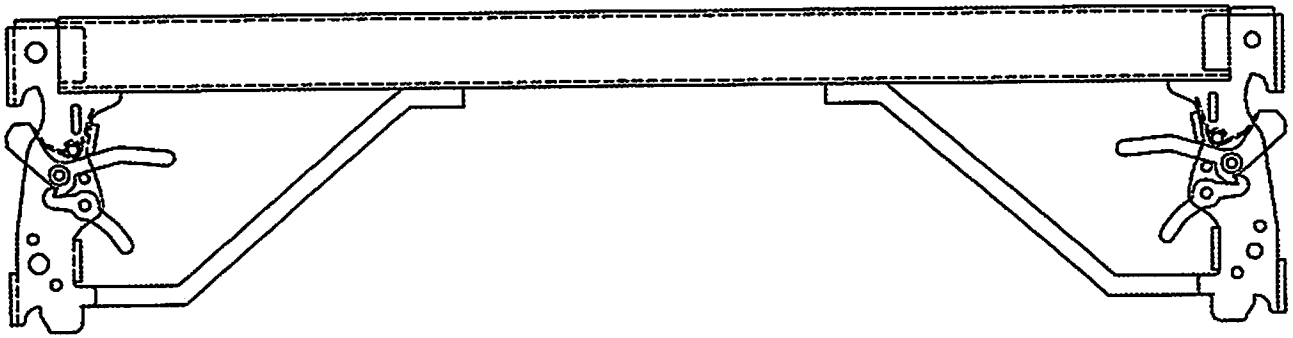
Figure 12C:
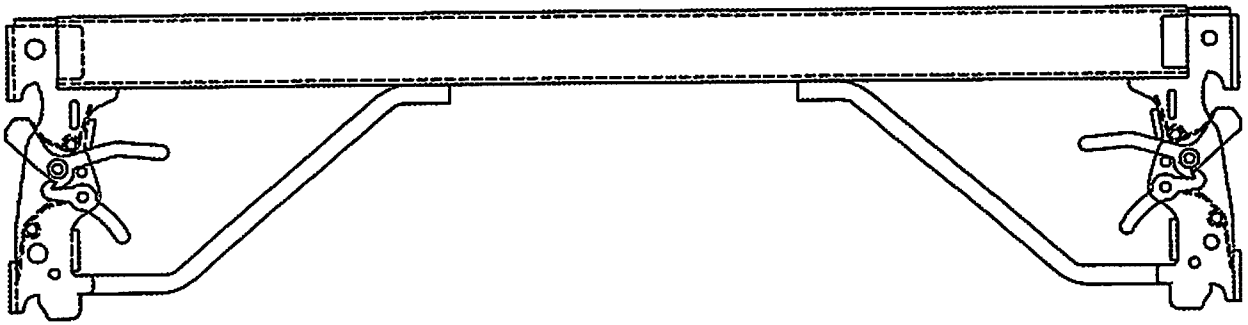
Figure 12D:
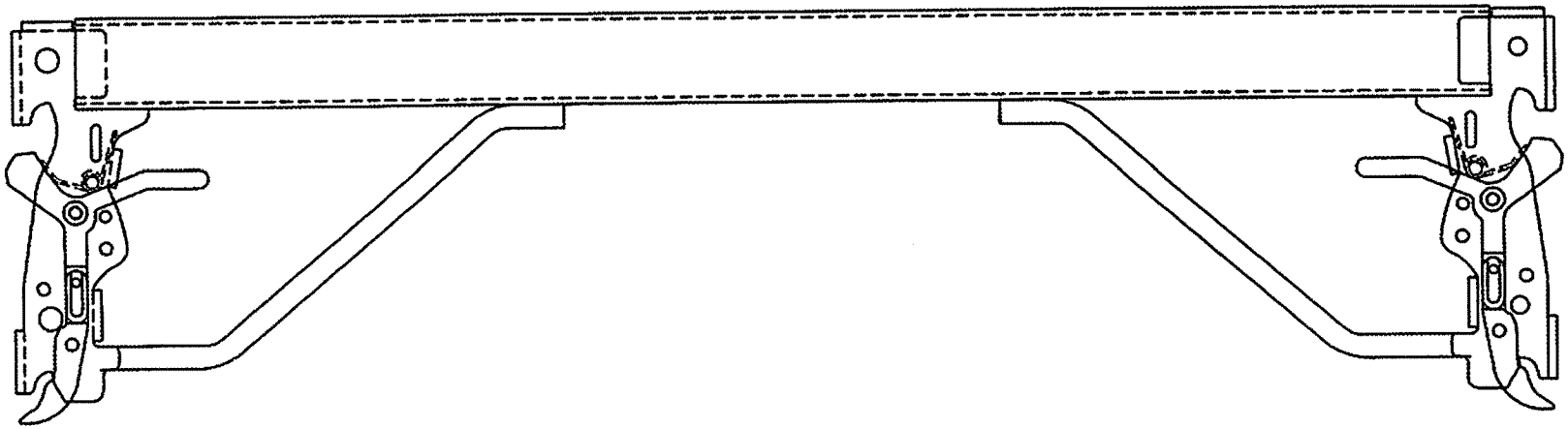
Figure 13:
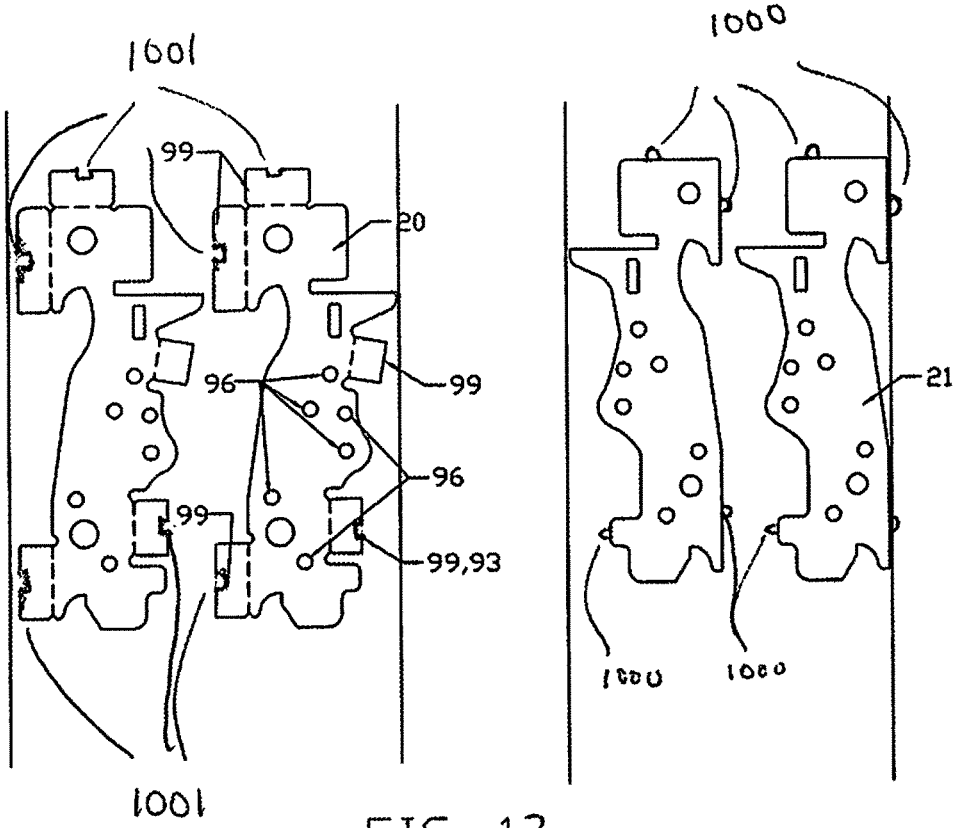
FIG. 13 is a top view of an alignment notch in a tab on one sidewall and the corresponding alignment finger on the other connector sidewall.

Shown in FIG. 11 is a preferred embodiment of a new end connector housing 19. For orientation, "front" or "frontwardly" (as opposed to "rear") references the end of the connector that attaches to a vertical scaffold member. "Up" or "upwardly" (as opposed to "down") references the "top" of the connector (when attached to a vertical scaffold member)(so upward motion is motion from the bottom of the connector toward the top of the connector). The housing has two opposing sides, forming an interior 23 there between. Each side is formed separately from a sidewall 20 and 21, best seen in FIG. 1. Sidewalls 20 and 21 are substantially mirror images of one another, with the exception of lateral tabs 99 and openings 97A, 97B, 98A and 98B (see FIG. 1). The end connector has a front and rear portion (from facing the vertical scaffold member). Lateral tabs may be formed in only one sidewall (preferred), as depicted in FIG. 1, or on both sidewalls (not shown). Each sidewall has an upper 25 and lower 26 engagement hook section for engaging a cup 300 or annular ring on a vertical scaffold member 100. The upper rear portion 28 of each side of the housing forms an insertion tab 41 that is sized to be inserted into the interior of a horizontal scaffold pipe 200 (see FIG. 2). In the embodiment shown, other than the lateral tabs 99, each side is substantially flat, including the insertion tab 41. The bottom of each insertion tab 41 is defined by a slot 42 in the housing sidewall, where the slot 42 is dimensioned to accommodate the wall thickness of the horizontal pipe scaffold member (accounting for the curvature of the pipe between the opposing insertion tabs). A rearward extending supporting finger 45 area is formed beneath the slot 42 on each housing sidewall to create additional surface area for welding each sidewall of an end connector to a horizontal pipe. See FIG. 2. As described, the sidewall usually will be fixedly joined to the pipe only along the rearward supporting finger 45. As the insertion tabs 41 are to be inserted into the interior of the horizontal pipe 200, the insertion tabs 41 do not need to be shaped into a portion of a cylindrical surface—indeed, it is preferred that these tab be flat, flush with the respective sides of the connector 19.

Additionally, a lateral tab 99 can be formed at the top 44 of a sidewall, forming a top cover 90 when the tab 99 is bent or folded ninety degrees to the plane of the connector sidewall. The top cover 90 will close the opening on the top of the connector when the two sidewalls 20 and 21 are joined together, thereby protecting the latching components interior to the connector. The top edge 43 of each insertion tab 41 is preferably lower than the top cover 90 of the connector. Preferably, the difference in height is sufficient to accommodate the thickness of a horizontal scaffold pipe so that when an end connector is attached to a horizontal scaffold pipe 200 (the insertion tab 41 is inserted into the interior of a pipe 200), the top cover 90 is substantially flush with the top exterior of the horizontal scaffold pipe (see FIG. 2).

The connector 19 housing is preferably formed from plate steel using a die operation. Each sidewall of the connector 21, 20 is separately cut or stamped by a die operation, with desired lateral tabs 99 and openings 96 formed to accommodate the pivot pins. An example of layouts for end connector sidewall 21 and 20 formation is shown in FIG. 1. Other layouts can be designed to minimize the waste metal from the die operation. The location of the desired lateral tabs 99 for the end connector will depend on the latching mechanism selected. For instance, latch handle portions that extend out of the housing must not be blocked by lateral tabs. Additionally, the lateral tabs also are used as a spring biasing surface when spring loaded latches are utilized (see, e.g., FIG. 5), and hence, must be located for engagement with the desired biasing springs. Finally, the openings 96 cut to accommodate pivot or support pins (for spring operation) will be dependent on the type of latch mechanism deployed in the connector. The sidewall layout for sidewalls 20 and 21 shown in FIG. 1 is suitable for the three latching mechanism disclosed herein (See FIGS. 12A-12D).

In the preferred embodiment, the two sidewalls 20 and 21 of the connector housing are separately formed and each substantially flat (excluding the lateral tabs 99), thus avoiding the metal deformation, potential twisting and associated alignment problems inherent in the prior art connectors. By forming each sidewall 20 and 21 separately, the layout can also be optimized for conserving metal, resulting in less scrap metal then created by the prior art end connectors. Finally, a horizontal scaffold pipe 200 joins to the new connecter 19 closer to the hook sections 25 and 26 (about 1.25 inches closer), and as the insertion tabs are internal to the pipe. Hence, there is no increase in the external diameter of the joint at the pipe end, so the new connector 19 allows a scaffold board to be positioned much closer to the edge of the new connector 19, and closer to a vertical scaffold member (almost 3 inches closer than the prior design), providing for a safer work surface.

Assembly of a Horizontal Scaffold Member

Because the two sidewalls are separately formed, a jig 1 is used to couple the two sidewalls 20 and 21 into a completed end connector and to form a horizontal scaffold member. Top openings 98A and 97A, and bottom openings 98B and 97B on sidewalls 20 and 21 are designed for use with the jig. The top openings 98A and 97A are designed to be aligned in a completed end connecter (that is the center of each opening is aligned on a line that is perpendicular to the plane of the openings), as are the bottom openings 98B and 97B. However, the openings 97A and 97B on sidewall 21 are smaller than the openings 98A and 98B on sidewall 20 (in the current embodiment, openings 97 are about 0.375 inches in diameter, while openings 98 are about 0.500 inches in diameter). This difference is size is used to assist in assembling the two sidewalls 20 and 21 into a completed end connector, as follows.

Figure 9:
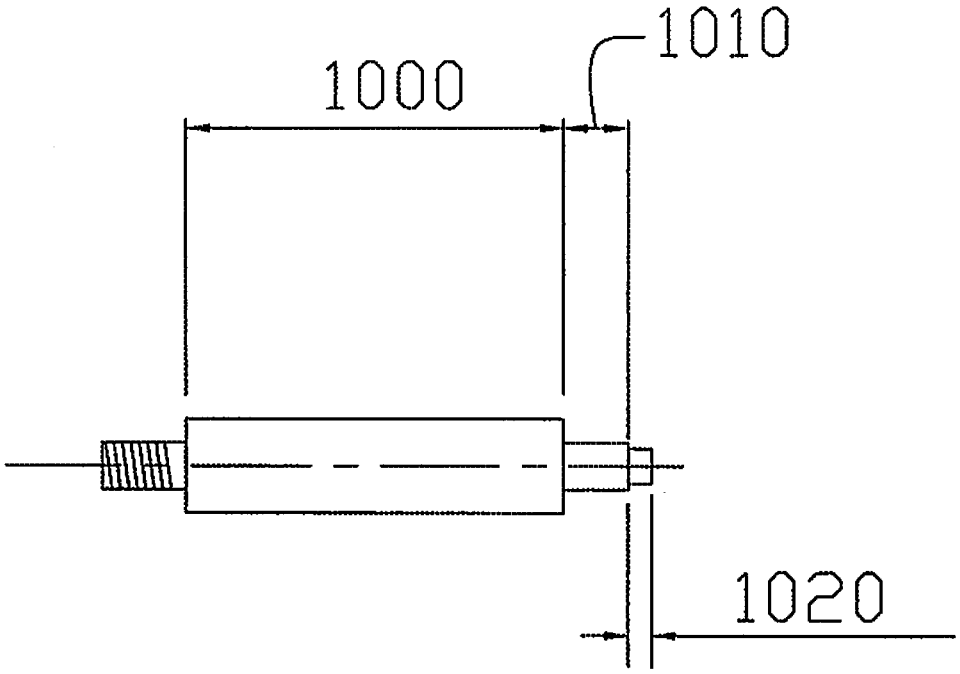
FIG. 9 is a side view of a fixture used to assemble the end connector of FIG. 2.
Figure 10:
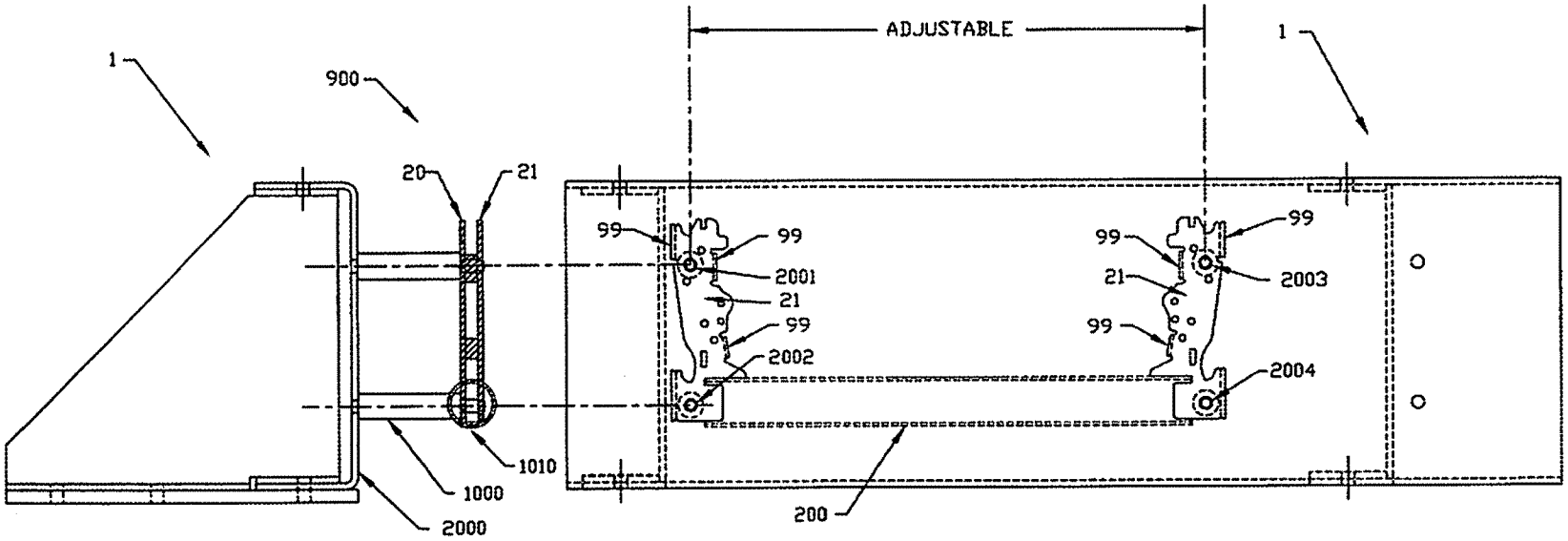
FIG. 10 is a side and top view of an assembly jig for a horizontal scaffold member employing the fixture of FIG. 9.

The assembly jig 1 includes four preferably identical standoff members 900 at locations 2001, 2002, 2003 and 2004, as shown in FIG. 10. The standoff member shown in FIG. 10 is a "stacked" cylinder that is attached to the jig structure (see FIG. 9). The standoff 900 has three cylindrical volumes, a first cylinder 1000 having a diameter larger than that of the openings 98A and 98B, a second cylindrical volume 1010 having a diameter slightly smaller than that of openings 98A and 98B, and a third cylindrical volume 1020 having a diameter slightly smaller than that of opening 97A and 97B. Instead of stacked cylinders, the standoff members may be a tapered cone, or a combination of a tapered cone and stacked cylinders, each considered as a tapered mount.

To assemble a horizontal scaffold member, a sidewall 20 is slipped over the standoffs 900 located at opposite ends of the jig (e.g. one sidewall over positions 2001 and 2002; another sidewall at positions 2003, 2004). Sidewall 20 will butt up against the end of cylindrical volume 1000 of standoffs 900. Next, two sidewall 21*s* are slipped over the standoffs 900 at opposite ends of the jig. Sidewall 21 will butt up against the end of cylindrical volume 1010. The length of cylindrical volume 1010 (the distance between cylinders 1000 and 1020) is set to the desired spacing between the sidewalls 20 and 21 of the connector (creating the interior space) plus the thickness of sidewall 20. Hence, the four standoffs 900 are located on the jig to position the adjacent sidewalls 20 and 21 of an end connector in the proper spatial relationship, as well as to position the two opposing end connectors to accept a pipe 200 in the proper spatial relationship—i.e. the sidewalls 21 and 20 of each end connector 19 are properly aligned and separated by the proper distance, and the two opposing end connectors 19 are aligned in a single plane to accept a pipe 200 therebetween.

To help position the two sides in the jig, the lateral tabs (some or all) may have formed therein a notch 1001, where this notch will mate with a projecting nub 1000 on the other side member. Alternatively the nub 1000 may be positioned on the lateral tab with the notch 1001 positioned on the side wall that will be juxtaposed or placed adjacent to the corresponding sidewall having the nub 1000 in the lateral tab (not shown).

The sidewalls 20 and 21 are held in place on the standoffs by a clamp, snap cap, or other means. The desired length of pipe is added between the two assembled end connectors (preferably, the jig is designed so that the space between the two end connectors is adjustable, to allow the construction of various length horizontal scaffold members), by inserting insertion tabs 41 into the interior of the pipe 200. The braces are placed in position on the end connector/pipe combination (not shown), and the assembly is ready for welding. As can be seen, the free end of the bent or folded lateral tabs 99 are now positioned adjacent to sidewall 21, away from the jig 1, for ease of welding. Hence, all areas to be welded are easily accessible for automatic welding. Indeed, the length of the cylindrical volume 1000 is designed to sufficiently offset sidewall 20 from the face 2000 of the jig to allow welding of sidewall 20 to the pipe 200 without the need to reposition the assembly. Automatic welding by a robot can readily be accomplished. After welding, galvanization (if desired) will be undertaken, and finally, the desired latching device will be positioned in the interior of the welded end connectors.

As can be seen, the assembly jig ensures that the connector sidewalls 20 and 21 are properly positioned with respect to each other, that the two end connectors of the horizontal scaffold member lie in the same plane, and further, that each end connector forms a right angle with the pipe. Hence, the twisting and misalignment problems of the prior art connectors are not present.

Finally, shown in both sidewalls 20 and 21 is slot 94. Slot 94 vertically aligns with the bottom inner folded lateral tab 93 (see FIG. 1). Slot 94 is designed to accommodate a tape measure. In a completed horizontal scaffold member, the distance between slots 94 on the two end connectors of a horizontal scaffold member should match the distance between the corresponding folded lateral tabs 93 on the two end connectors. If these lengths do not match (within tolerance), the end connectors may be misaligned, indicating the horizontal scaffold member may be damaged.

Locking Latch

The connector 19 can house the single latch mechanism (FIG. 12A) or the double latch mechanism discussed (see, e.g. FIG. 12D) previously, or any other latching configuration. The location of the lateral tabs 99 and pivot holes 96 can be customized to accommodate the latches and any biasing springs required for a particular latch design.

Figure 3:
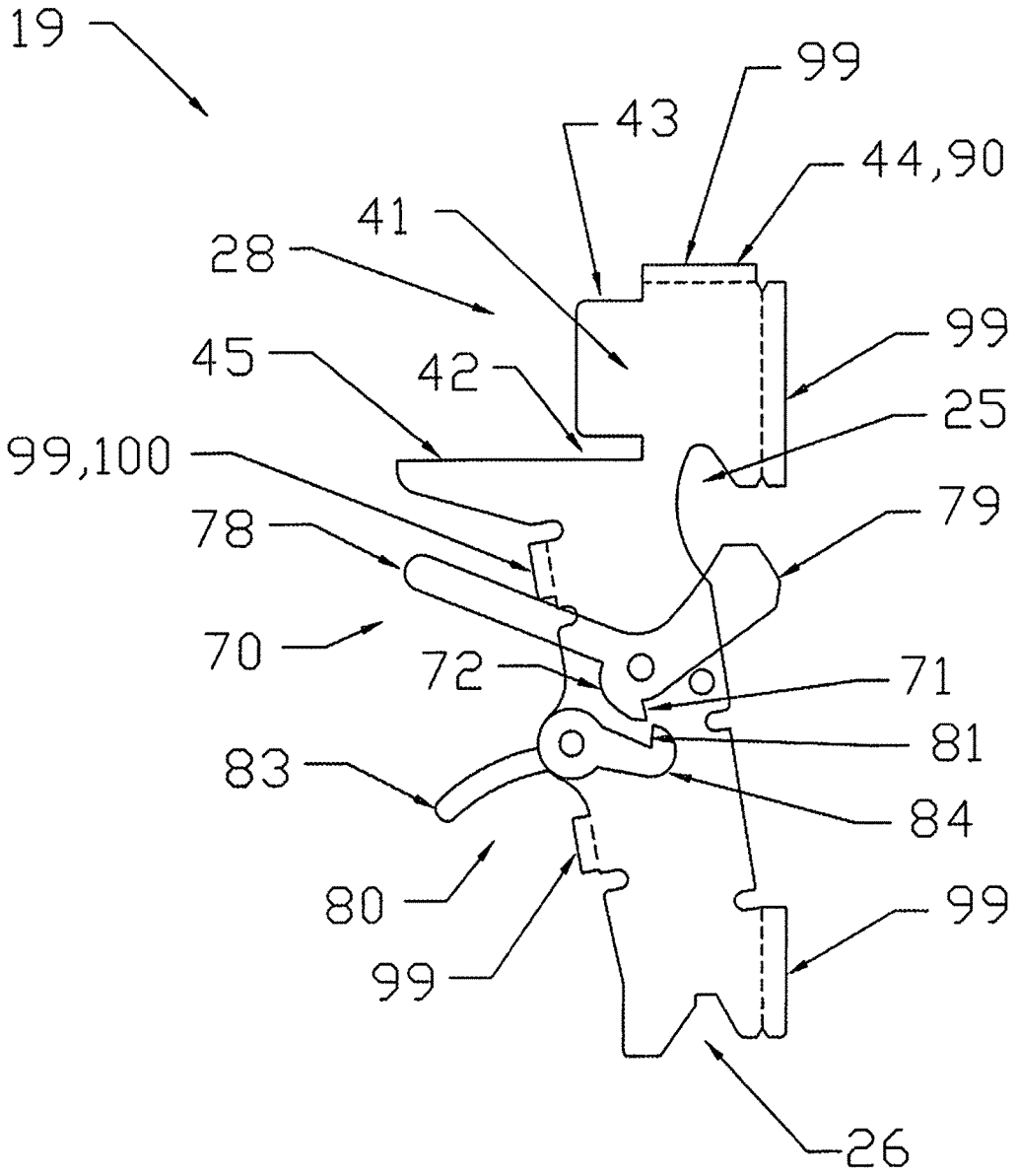
FIG. 3 is a cross section through the embodiment of the connector housing showing one embodiment of a locking latch deployed in the interior of the connector housing.
Figure 4:
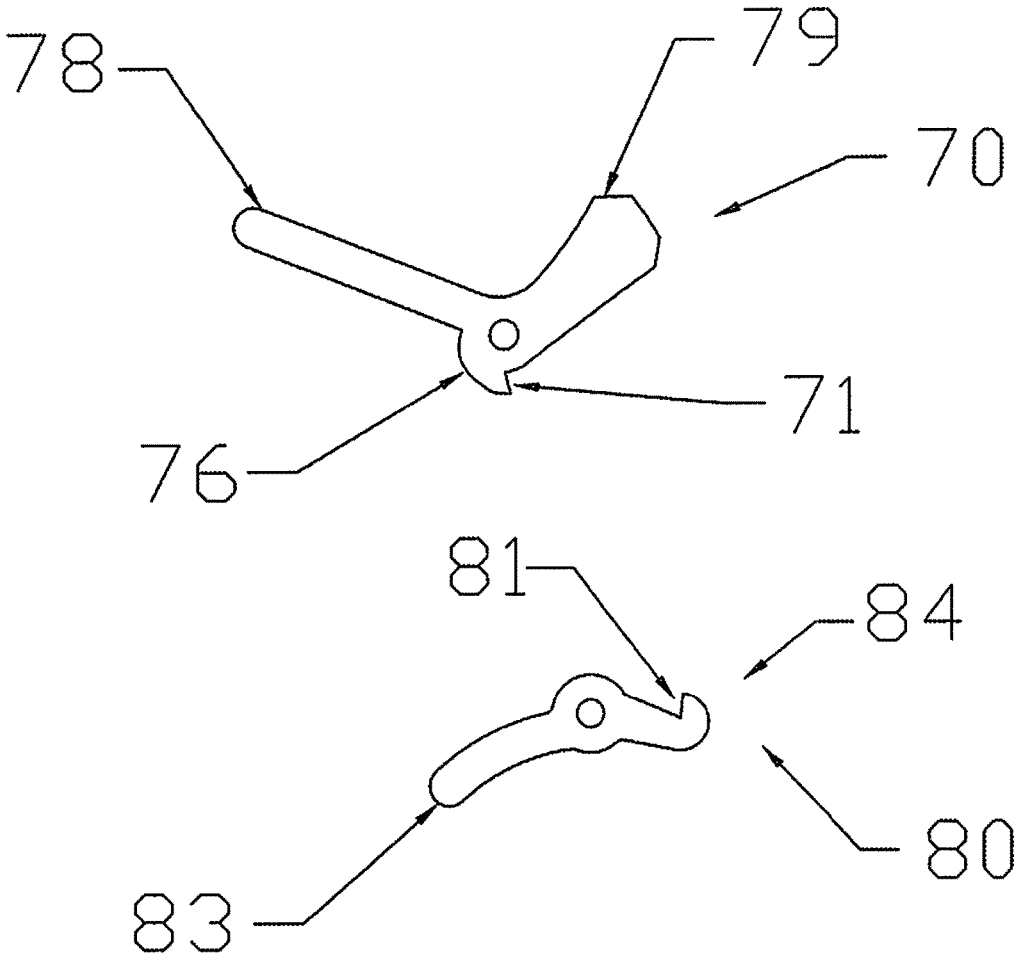
FIG. 4 is a top view of the locking latch members for the locking latch of FIG. 3.
Figure 5:
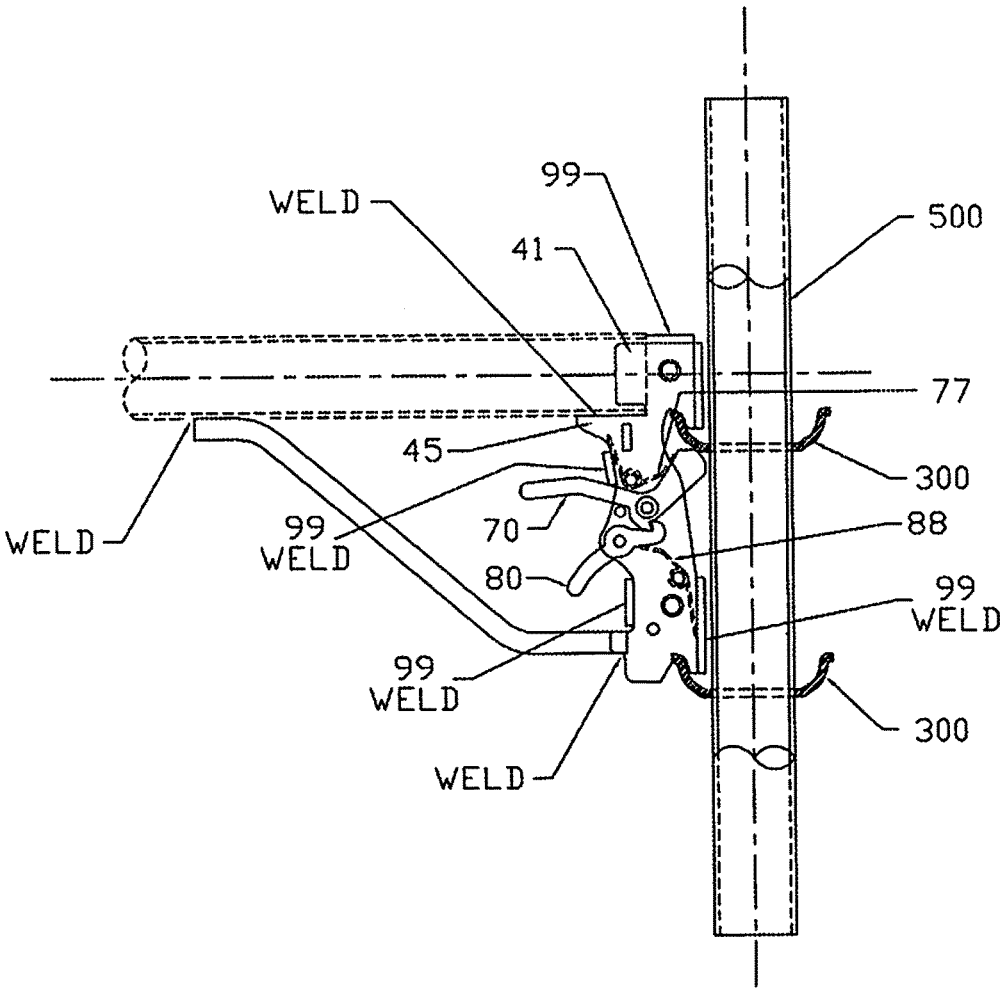
FIG. 5 is a cross section through one embodiment of a new connector housing installed in a scaffold joint, where a dual latch member is deployed within the connector housing, detailing spring loading of the latch and load members.
Figure 6:
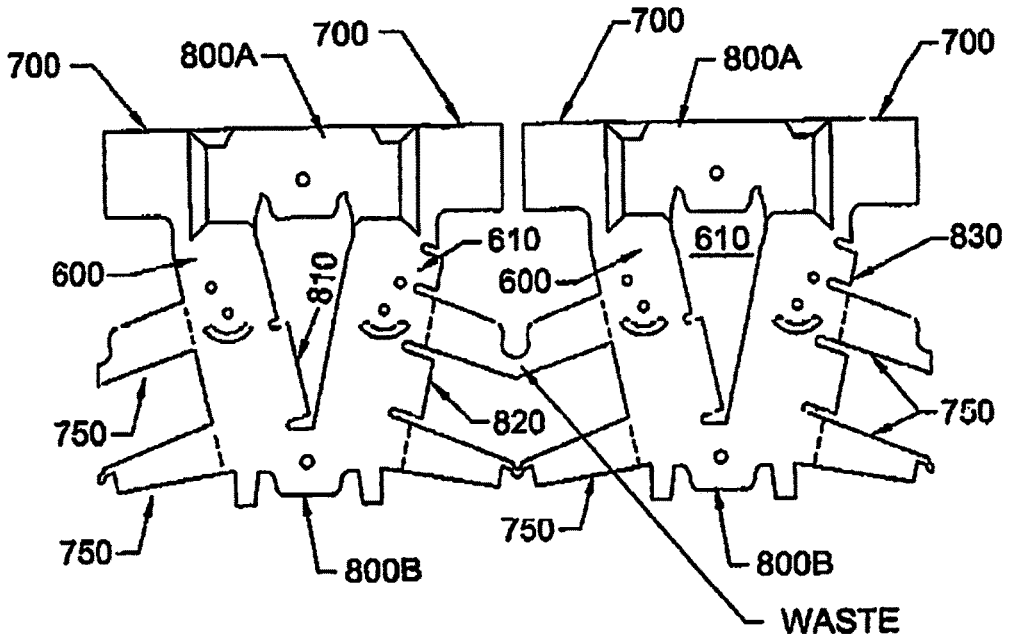
FIG. 6 (Prior Art)
FIG. 6 is the outline of the punched prior art housing.
Figure 7A:
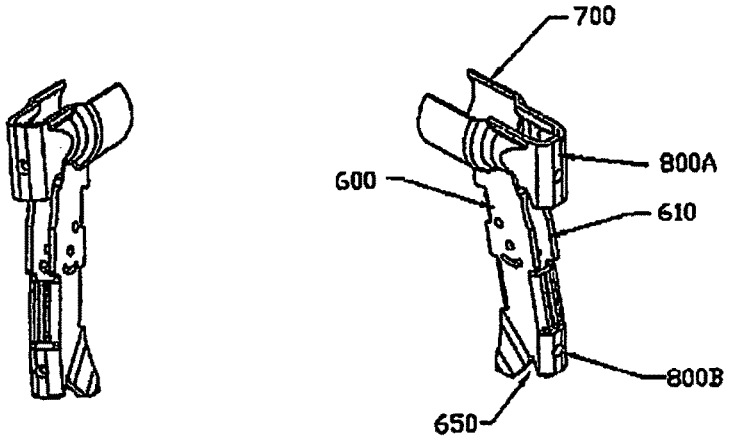
FIG. 7A (Prior Art)
FIG. 7A are perspective views of the prior art housing design.
Figure 7B:
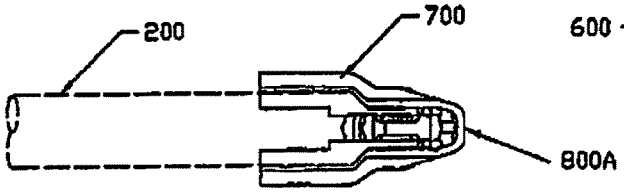
FIG. 7B (Prior Art)
FIG. 7B is a top view of the prior art housing design of FIG. 7A.
Figure 7C:
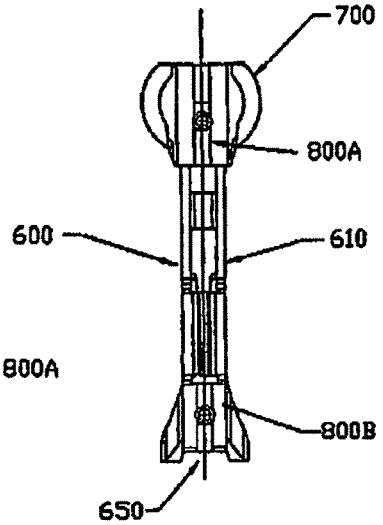
FIG. 7C (Prior Art)
FIG. 7C is an end view of the prior art housing of FIG. 7A.
Figure 8A:
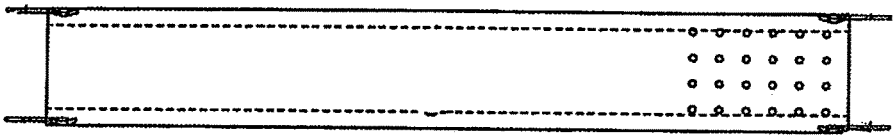
FIG. 8A is a top view of a scaffold board.
Figure 8B:
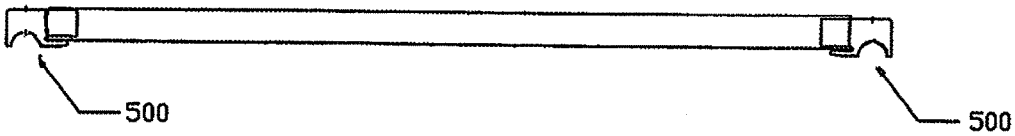
FIG. 8B is a side view of a scaffold board.
Figure 8C:
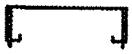
FIG. 8C is an end view of the scaffold board of FIGS. 8A and 8B.

A new locking latch is shown partially disposed in the interior of an end connector housing 19 in FIGS. 5 and 3. The locking latch comprises a upper pivoting latch member 70 and a lower pivoting lock member 80, together creating a means to lock latch member in a latched position. Each member pivots on pivot pins located in the interior of the housing (here bolts through the housing). The positive lock is created as latch member 70 is biased to rotate opposite that of lock member, and hence, the two members can be designed to obstruct or interfere.

The preferred upper latch member 70 is an "L" shaped body similar to that disclosed in the U.S. Pat. No. 5,078,532, having a distal end 79, the engagement end, shaped for positioning beneath a cup or annular ring (to trap the cup or ring between the latch and the hook section), and a proximal end 78 that forms a handle. As in prior embodiments, the upper latch member 70 is positioned below the top hook portion of the housing to allow the distal end 79 to be positioned beneath a ring member, annulus or cup on a vertical scaffold member. Preferably, the upper latch member 70 is biased (such as by spring 77 see FIG. 5) into an actuated position or latched position (i.e. latch member handle 78 rotates upwardly to bias the distal end 79 toward a vertical scaffold member). Biasing indicates that some positive action must be taken to move the latch from an actuated position to a released position (non-latched). A spring biasing means is not required, particularly if the distal end 79 is sufficiently weighted so that the latch member 70 will naturally be biased to rotate to the actuated or latched position when the connector is vertically orientated. The biased rotation of the latch member 70 is stopped when the handle portion 78 contacts the upper rear join area 100 (created by a folded lateral tab). Positioned on the underside of the upper latching member 70 is upper latch catch 71, a downward facing finger projection, shaped to interfere with a corresponding shaped upward facing finger projection (a lower locking catch 81) on the upper side of lower locking member 80.

A preferred pivoting lower lock member 80 has a proximal end 83 forming a handle and a distal end 84, where the lock catch 81 is positioned on the upper surface near the distal end 84. The lower lock member 80 is biased to rotate opposite that of the latching member 70 (i.e. the lock member handle is biased to rotate downwardly, such as by a spring 88 (see FIG. 5), or by a sufficiently weighted proximal handle end 83). Hence, lower lock catch 81 is biased into a locked position—engagement with upper latch catch 71. When the catches 71 and 81 are engaged, a positive lock is achieved—upper latching member 70 cannot rotate to an unlatched or released position due to the interference to such rotation caused by lock catch 81 bearing on latch catch 71. Upward rotation of the lock handle moves the lock member to an unlocked position—the lock catch is disengaged from the latch catch.

Upon engagement of the catch areas, the upper latch member 70 cannot be rotated (upward rotation of the handle is resisted by stop 100, while downward rotation of the handle is prevented by the engagement of the two catch areas). Hence, the end connector latch is normally biased into a locked actuated position. Disengagement of the locking latch cannot be achieved unless the lock member handle 83 is rotated upwardly, while latch member handle 78 is rotated downwardly. Due to the biasing of the two members 70 and 80, and the positioning of the two members 70 and 80 in the housing, this unlocking action can be achieved by an operator grasping the exposed handles (78 and 83) and squeezing the two handles together, a natural release operation. If the operator releases the handles 78, 83, the two members will again be biased so that the catch members 71 and 81 are engaged. To assist in engagement, the rear lower side 76 of locking catch 71 is curved to allow the projecting finger, or catch 71, to slide on the curved area 76 until the two locking catches 71 and 81 come into an engaged relationship.

To assemble and disassemble the scaffold joint with this locking latch, an operator must first release the lock. While it is possible to first release the lock member and then release the latch member, the more natural motion is to release both at the same time by grasping both handles and squeezing.

The locking latch apparatus described can be utilized in the prior art modular housing end connectors as well as the new end connector housing. Indeed, the locking latch can be used in an end connector designed with a single hook section (e.g. without the bottom hook section) but such is not preferred.

What is claimed is:

1. A horizontal scaffold member comprising a pipe having two ends and an interior, and a scaffold end connector positioned on each of said pipe ends;

each of said scaffold end connectors comprising a pair of substantially parallel plates defining a pair of opposing sidewalls and a front portion and a rear portion of said scaffold end connector;

each of said scaffold end connectors having a bottom end and a top end and two spaced apart engagement sections positioned on said front portion of said scaffold end connector;

each of said scaffold end connectors further comprising at least two lateral tabs extending between said opposing sidewalls, each of said lateral tabs extending from one of a respective said top end, said front portion or said rear portion of said scaffold end connector, each of said sidewalls fixedly joined to the other with at least one of said lateral tabs;

each of said scaffold end connectors having an interior located between said two sidewalls; each of said two sidewalls having an insertion tab extending from said rear portion on said top end of said scaffold end connector, and a bottom slot extending through said sidewall positioned below said insertion tab, said insertion tabs positioned in said pipe interior; and each of said scaffold end connectors further having a movable latch member partially disposed in said end connector interior, and mounted in said connector interior for latching said scaffold end connector to a cup or annular ring positioned on a vertical scaffold member.

2. The horizontal scaffold member according to claim 1 wherein each said sidewall has a rearward supporting finger located beneath said bottom slot, and said pipe is fixedly joined to said sidewalls at said rearward supporting fingers.

3. The horizontal scaffold member of claim 2 further having a plurality of pivot pin openings in each said sidewall, said plurality of pivot pin openings in one of said sidewalls being aligned with said plurality of pivot pin openings in the other of said sidewalls, each pivot pin opening sized to accept a pivot pin for a latch member.

4. The horizontal scaffold member of claim 2 wherein said pipe has an exterior surface and said rearward supporting finger is welded to said exterior surface of said pipe.

5. The horizontal scaffold member of claim 2 wherein said latch member is slidable in said scaffold end connector.

6. The horizontal scaffold member of claim 2 wherein said latch member is pivotable in said scaffold end connector.

7. The horizontal scaffold member according to claim 1 wherein said top end of said scaffold end connector further comprises one of said lateral tabs, thereby forming a top lateral tab, and said top lateral tab has a top surface substantially level with the outer surface of said pipe adjacent said top lateral tab.

8. The horizontal scaffold member of claim 1 further having a slot through each of said sidewalls positioned below said insertion tab.

9. The horizontal scaffold member of claim 1 wherein each of said engagement sections comprises a downwardly facing hook section.

10. The horizontal scaffold member of claim 1 wherein each of said sidewalls is fixedly joined to the other with one of said lateral tabs located on the front portion of said end connector, and another of said lateral tabs located on the rear portion of said scaffold end connector.

11. A horizontal scaffold member comprising a pipe having two ends and an interior, and a scaffold end connector positioned on one of said pipe ends;

said scaffold end connector comprising a pair of substantially parallel plates defining a pair of opposing sidewalls, said scaffold end connector having a front portion, a rear portion, a bottom end and a top end;

said scaffold end connector having two spaced apart engagement sections positioned on said front portion;

said scaffold end connector further comprising at least two lateral tabs, each lateral tab extending from one or the other of said two sidewalls, each lateral tab extending from a respective top edge or a front edge or a rear edge of the respective sidewall, each of said opposing sidewalls fixedly joined to the other sidewall with said lateral tabs, said scaffold end connector having an interior located between said two sidewalls;

each of said two sidewalls having an insertion tab extending from the rear portion proximal said top end, and a bottom slot extending through said sidewall positioned below said insertion tab, said insertion tabs being positioned into said pipe interior; and said scaffold end connector further having a movable latch member mounted in the interior of the end connector, moving between a retracted and a deployed position, for latching said scaffold end connector to a cup or annular ring positioned on a vertical scaffold member in the deployed position.

12. The horizontal scaffold member according to claim 11 wherein each said sidewall has a rearward supporting finger located beneath said bottom slot, and said pipe is fixedly joined to said sidewalls at said rearward supporting fingers.

13. The horizontal scaffold member according to claim 12 wherein said pipe has an exterior surface and said rearward supporting finger is welded to said exterior surface of said pipe.

14. The horizontal scaffold member according to claim 13 wherein said top end of said scaffold end connector further comprises one of said lateral tabs, thereby forming a top lateral tab, and said top lateral tab has a top surface substantially level with the outer surface of said pipe adjacent said top lateral tab.

15. The horizontal scaffold member of claim 13 wherein said latch member is pivotable or slidable in said scaffold end connector.

16. The horizontal scaffold member of claim 15 wherein said latch member is biased to a latched position.

17. The horizontal scaffold member of claim 15 further comprising a brace having two ends, one of said ends fixedly connected to said scaffold end connector near said rear portion, bottom end of said scaffold end connector, the other end of said brace fixedly connected to said pipe.

18. A horizontal scaffold member, comprising:

a) a pipe having a first end, a second end, and an interior; and b) a first scaffold end connector coupled to the first end of the pipe, the first scaffold end connector comprising: (i) a first pair of substantially parallel plates, the first pair of substantially parallel plates defining first opposing sidewalls, a first interior cavity defined by the first opposing sidewalls, a front portion distal from the first end of the pipe, a rear portion proximate to the first end of the pipe, a top end proximate to the first end of the pipe, and a bottom end distal from the first end of the pipe; (ii) a first upper hook formed in the front portion of each of the first opposing sidewalls proximate to their top end; (iii) a first lower hook formed in the front portion of each of the first opposing sidewalls proximate to their bottom end; (iv) a first plurality of lateral tabs extending between the first opposing sidewalls for fixedly joining the first opposing sidewalls together; (v) a first insertion tab formed in the rear portion of the first opposing sidewalls proximate to their top end, the first insertion tab adapted to be positioned within the interior of the first end of the pipe; (vi) a first slot formed in the rear portion of the first opposing sidewalls below the first insertion tab; and (vii) a first movable latch partially disposed in the first interior cavity and movable between a retracted position and a deployed position, wherein the deployed position is defined by the movable latch member being positioned beneath an annular ring positioned on a first vertical scaffold member; and c) a second scaffold end connector coupled to the second end of the pipe, the second scaffold end connector comprising: (i) a second pair of substantially parallel plates, the second pair of substantially parallel plates defining second opposing sidewalls, a second interior cavity defined by the second opposing sidewalls, a front portion distal from the second end of the pipe, a rear portion proximate to the second end of the pipe, a top end proximate to the second end of the pipe, and a bottom end distal from the second end of the pipe; (ii) a second upper hook formed in the front portion of each of the second opposing sidewalls proximate to their top end; (iii) a second lower hook formed in the front portion of each of the second opposing sidewalls proximate to their bottom end; (iv) a second plurality of lateral tabs extending between the second opposing sidewalls for fixedly joining the second opposing sidewalls together; (v) a second insertion tab formed in the rear portion of the second opposing sidewalls proximate to their top end, the second insertion tab adapted to be positioned within the interior of the second end of the pipe; (vi) a second slot formed in the rear portion of the second opposing sidewalls below the second insertion tab; and (vii) a second movable latch member partially disposed in the second interior cavity and movable between a retracted position and a deployed position, wherein the deployed position is defined by the movable latch member being positioned beneath an annular ring positioned on a second vertical scaffold member.

* * * * *